US008267707B2

(12) United States Patent
Rogers

(10) Patent No.: US 8,267,707 B2
(45) Date of Patent: Sep. 18, 2012

(54) UNDERWATER OR SUB SEA CONNECTORS

(75) Inventor: John Neil Rogers, Ulverston (GB)

(73) Assignee: Tronic Limited, Cumbria (GB)

( * ) Notice: Subject to any disclaimer, the term of this patent is extended or adjusted under 35 U.S.C. 154(b) by 0 days.

(21) Appl. No.: 13/020,148

(22) Filed: Feb. 3, 2011

(65) Prior Publication Data

US 2011/0189878 A1 Aug. 4, 2011

Related U.S. Application Data

(60) Provisional application No. 61/337,353, filed on Feb. 3, 2010.

(51) Int. Cl.
*H01R 13/52* (2006.01)

(52) U.S. Cl. ..... 439/271

(58) Field of Classification Search ..... 439/271, 439/578, 201, 79, 931, 275, 587
See application file for complete search history.

(56) References Cited

U.S. PATENT DOCUMENTS

| | | | | |
|---|---|---|---|---|
| 4,142,770 | A * | 3/1979 | Butler et al. | 439/140 |
| 4,464,540 | A | 8/1984 | Reeder | |
| 4,606,603 | A | 8/1986 | Cairns | |
| 4,948,377 | A | 8/1990 | Cairns | |
| 5,344,341 | A | 9/1994 | Yoshino | |
| 6,379,175 | B1 * | 4/2002 | Reede | 439/418 |
| 6,491,529 | B2 * | 12/2002 | Gray et al. | 439/79 |
| 6,916,188 | B2 * | 7/2005 | Lang et al. | 439/101 |
| 7,018,239 | B2 * | 3/2006 | Zaderej et al. | 439/607.36 |
| 7,429,193 | B2 * | 9/2008 | Cairns et al. | 439/578 |
| 7,959,454 | B2 * | 6/2011 | Ramasubramanian et al. | 439/201 |
| 2007/0259568 | A1 | 11/2007 | Mackillop et al. | |

FOREIGN PATENT DOCUMENTS

| | | |
|---|---|---|
| CN | 2449383 | 9/2001 |
| EP | 0308092 A2 | 3/1989 |
| EP | 0929915 | 3/2006 |
| GB | 2011193 | 7/1979 |
| GB | 2192316 | 1/1988 |
| GB | 2361365 | 10/2001 |
| GB | 2424770 | 10/2006 |
| GB | 2459571 | 11/2009 |
| WO | WO 9712428 | 4/1997 |

OTHER PUBLICATIONS

The Evolution of ROV Wet-Mate Connector Technology in Supplying High Bandwidth/High Power/Deep Water Solutions for the Scientific Ocean Observatory Market.
European Search Report dated Apr. 28, 2011.

* cited by examiner

*Primary Examiner* — Jean F Duverne
(74) *Attorney, Agent, or Firm* — Alix, Yale & Ristas, LLP

(57) ABSTRACT

Connector part for making an electrical connection with a complementary connector part while underwater or in a harsh environment, the connector part comprising: first and second axially extending, electrically conductive signal-carrying elements, the connector part being configured such that, on mating with the complementary connector part in normal use, the signal-carrying elements electrically contact with respective signal-carrying elements of the complementary connector part to form signal conduction paths between the connector parts, the signal conduction paths being sealed watertight; and electrically conductive crosstalk suppressing means electrically connected, in use, to earth and being arranged to, in use, extend between and thereby electrically shield the signal conduction paths from each other to suppress signal crosstalk therebetween.

20 Claims, 13 Drawing Sheets

UNDERWATER OR SUB SEA CONNECTORS

CROSS-REFERENCE TO RELATED APPLICATION

This application claims priority of U.S. Provisional Application No. 61/337,353 of 3 Feb. 2010.

BACKGROUND

The present invention relates to a wet mateable connector (a so-called underwater or sub-sea connector) for use in, for example, interfacing with sub-sea systems used in the exploration for and extraction of oil and gas from sub-sea deposits. The invention is particularly useful for interfacing Ethernet cabling and enabling Ethernet data communication with sub-sea systems.

Much electrical hardware used in the development, drilling and extraction of offshore and sub-sea oil and gas deposits is arranged submerged in the ocean, often on the sea bed in control systems or 'Christmas trees' at individual well heads, at depths of up to 4000 m, a harsh environment with pressures of up to 6000 psi. Many of the sub-sea systems monitor and control variables such as pressures, flow rates, etc at the well heads and reporting and control of these systems is achieved by wired telemetry, communicating electrical signals between sub-sea systems and to surface locations.

Interfacing and interconnecting these sub-sea systems to provide power distribution and signal communication is achieved with the use of, amongst other components, underwater mateable electrical connectors. Such connectors are known from, for example, United Kingdom patent application publication number GB-A-2192316, by which an electrical connection is made between two connector parts in an oil-filled chamber of one of the connector parts, sealed watertight.

Currently, signal communications with sub-sea systems are typically in the form of single channel analogue or digital voltage signals. However, as the number and complexity of deployed sub-sea systems is increasing, the volume of data that needs to be communicated is also increasing, which is putting greater demands on the network of cabling and connectors that interfaces and interconnects the sub-sea systems and surface systems.

There is therefore a need to provide hardware to enable a higher data throughput to be achieved in sub-sea communication lines.

The present inventors have recognised that the use of wired Ethernet technology for providing data communication with and between sub-sea systems is one way in which data throughput could be boosted significantly. Ethernet communication can be provided by optical fibre connections. For this, sub-sea hardware for providing a fibre optic communication infrastructure is already available that could be used for Ethernet communication. However, such hardware is expensive and may make deployment of Ethernet communication over short distances sub-sea impractical.

The present inventors have recognised that, while Ethernet communications links over relatively large distances could be provided by fibre optic connection, Ethernet communications over short distances sub-sea could be provided instead by a connection using twisted pair Ethernet cabling. To achieve this, twisted pair Ethernet cabling, according to the Cat 5, Cat 5e, Cat 6 or Cat 7 standard, could be incorporated in sub-sea cabling to provide connections between systems generally not more than about 100m apart, due to this being a limiting distance on operability.

The structuring of the Ethernet cabling in twisted pairs of separate conductors acts to isolate the signals carried in each pair from each other, from respective pairs, and from interference externally from the cabling. Such twisted pair cabling is normally terminated at an 8P8C modular connector plug to interface the cable with a corresponding 8P8C connector jack in a communication system. However, such modular connectors are not suitable for use sub-sea.

SUMMARY

Viewed from a first aspect, the present invention provides a connector part for making an electrical connection with a complementary connector part while underwater or in a harsh environment, the connector part comprising: first and second axially extending, electrically conductive signal-carrying elements, the connector part being configured such that, on mating with the complementary connector part in normal use, the signal-carrying elements electrically contact with respective signal-carrying elements of the complementary connector part to form signal conduction paths between the connector parts, the signal conduction paths being sealed watertight so that they are not exposed to ambient water; and electrically conductive crosstalk suppressing means electrically connected, in use, to earth and being arranged to, in use, extend between and thereby electrically shield the signal conduction paths from each other to suppress signal crosstalk therebetween.

The present inventors realised that twisted pair Ethernet could be connected sub-sea by terminating the conductors of the Ethernet cabling on the pins of known underwater mateable electrical connectors such as those disclosed in United Kingdom patent application publication number GB-A-2192316. However, within the connector, the twisted pair structuring that provides signal isolation between conductors in the cabling is unfurled, and the axial signal conduction paths formed within the underwater connector allow for significant crosstalk between the conductors which does not typically occur to the same extent when the cabling is terminated at an 8P8C conductor. Measurement of the Near End Crosstalk (NEXT) and Far End Crosstalk (FEXT) that results between the twisted wire pairs in Ethernet cable terminated by such an underwater mateable connector was found to fall below the requirements of the relevant Telecommunications Industry Association/Electronic Industries Alliance (TIA/EIA) Ethernet standard, and below the relevant International Organization for Standardization/International Electrotechnical Commission (ISO/IEC) standard.

The inventors have addressed this problem in the invention by providing an underwater mateable connector having a plurality of signal carrying paths for connecting e.g. Ethernet cabling conductors and one of the connector parts including electrically conductive crosstalk suppressing means, which is earthed and arranged to extend between the signal conduction paths in the connector when in the mated state. The crosstalk suppressing means acts to shield each signal conduction path from the other such that the electrical fields local thereto are electrically isolated and signal leakage through the crosstalk suppressing means is reduced, i.e. is partly or completely prevented. The crosstalk can be suppressed to the extent that, in the case of connecting Ethernet cabling conductors, the relevant TIA/EIA and/or ISO/IEC Ethernet standards are exceeded. By providing an appropriate underwater interfacing means, short distance sub-sea Ethernet communication over twisted wire pair cabling is thereby enabled by the connector part of the invention.

The connector part may comprise an environment of electrically non-conducting fluid (for example liquid or gel), arranged so that on mating the signal-carrying elements electrically contact with the respective signal-carrying elements of the complementary connector part in said environment. Thus, the electrical contact between the signal-carrying elements of the connector part with the respective signal-carrying elements of the complementary connector part, may take place in the electrically non-conducting fluid environment. Preferably therefore the crosstalk suppressing means is provided as part of the connector part which also provides an environment of electrically non-conducting fluid where the electrical connection is to take place on mating of the connector parts.

The electrically non-conducting fluid environment is preferably arranged so that its pressure tends to equalise with ambient external pressure, for example by the use of a bladder.

The connector part may comprise a sealed chamber filled with electrically non-conducting fluid (for example liquid or gel) and containing the signal-carrying elements and the crosstalk suppressing means. In this way the crosstalk suppressing means can be protected from the ambient environment. The sealed chamber may for example be provided by a circumferentially extending bladder.

The signal-carrying elements may be sealed in individual chambers filled with electrically non-conducting fluid (for example liquid or gel). The crosstalk suppressing means may be located inside one or more of the individual chambers, but preferably the crosstalk suppressing means extends between the individual sealed chambers. Thus the crosstalk suppressing means may be located outwardly of the individual sealed chambers. The individual chambers may optionally be provided together in an outer sealed chamber.

The crosstalk suppressing means may extend at least partly circumferentially round a respective signal-carrying element. The crosstalk suppressing means may extend at least partly circumferentially round each of the signal-carrying elements. The crosstalk suppressing means may extend circumferentially round a respective signal-carrying element so as to surround the element. The crosstalk suppressing means may extend circumferentially round each of the signal-carrying elements so as to surround the element.

The crosstalk suppressing means may comprise a metallic layer. There may be a metallic layer surrounding each of the signal-carrying elements. In the embodiments of the invention in which the signal-carrying elements are sealed in individual chambers filled with electrically non-conducting fluid, the respective metallic layers may be arranged around the individual sealed chambers. The respective metallic layers may be provided by metal foil. These optional arrangements are particularly advantageous as an effective crosstalk suppressing means that can be provided around each of the signal carrying elements and sealed chambers of a wet-mateable electrical connector part.

The crosstalk suppressing means may comprise a conductive insert member. This may be arranged to extend between the signal conduction paths in normal use. The conductive insert member may be inserted axially into position in the connector part, providing a simple assembly method. In the embodiments in which the signal-carrying elements are sealed in individual chambers filled with electrically non-conducting fluid, the conductive insert member may extend in a gap between the individual sealed chambers. Here, once the connector part is assembled and the sealed individual chambers are formed, the conductive insert member may be easily inserted axially into the gap between them. This optional arrangement is particularly advantageous as an effective crosstalk suppressing means that can be provided by a conductive part inserted between the conduction paths and sealed chambers of a wet-mateable electrical connector part. This provides an effective and simple construction. The conductive insert member may be immersed in an electrically non-conducting fluid (for example liquid or gel). In the embodiments in which individual chambers are provided together in an outer sealed chamber, the conductive insert member may be immersed in an electrically non-conducting fluid in the outer chamber, whilst being located outwardly of the individual sealed chambers.

An earth connector, for example an earth-connecting pin, may extend to the back of the connector part and be arranged to, in use, electrically connect the crosstalk suppressing means to earth. The signal-carrying elements may extend in and project forwardly from a supporting member, and the earth connector may extend axially through the supporting member. This provides a way of connecting the crosstalk suppressing means to earth (for example, a drain wire in the sub-sea cable) through the part supporting the conductive elements. As discussed above, the crosstalk suppressing means may be contained in a sealed chamber, for example provided by a circumferentially extending bladder, and this optional arrangement provides a mechanism to earth the crosstalk suppressing means without having to form an opening in the bladder wall.

The signal-carrying elements may terminate conductors of twisted pair Ethernet cabling. The connector part may comprise four signal-carrying elements each electrically connected a different one of four conductors of a twisted pair Ethernet cable, the crosstalk suppressing means being arranged to substantially suppress crosstalk between the four respective signal conduction paths. The connector part may comprise eight signal-carrying elements each electrically connected a different one of eight conductors of a twisted pair Ethernet cable, the crosstalk suppressing means being arranged to substantially suppress crosstalk between the eight respective signal conduction paths. Ethernet cabling typically has eight conductors arranged in four twisted pairs. Depending on the Ethernet communications standard used, four or eight of the conductors carry a signal. Therefore at least four and preferably eight crosstalk isolated signal conduction paths are required through the connector.

Where more than two signal conduction paths are provided, and the crosstalk suppressing means comprises a conductive insert member, a single such insert member may serve to suppress crosstalk between more than two signal conduction paths. This can help to reduce the number of components forming the connector part.

The connector part may further comprise an axially extending, electrically conductive power-carrying element, the connector part being configured such that, on mating with the complementary connector part in normal use, the power-carrying element electrically contacts with a respective power-carrying element of the complementary connector part to form a power conduction path between the connector parts, the power conduction path being sealed watertight. The connector part may comprise four power-carrying elements. In this way, a single sub-sea connector can be used to interface power and also Ethernet communications.

The invention also provides a connector comprising a connector part as discussed in this specification (in its broadest terms or including any of the optional or preferred features described) as a first connector part, and comprising the complementary connector part as a second connector part adapted to mate with the first connector part. Preferably, the signal-carrying elements of the first connector part comprise electrical contacts for making respective electrical connections with respective contacts of the signal-carrying elements of the second connector part, the signal-carrying elements of the second connector part being formed as axially extending electrical contact pins; and wherein the connector is configured such that, on mating the first and second connector parts in normal use, the contact pins of the second connector part enter a sealed chamber of the first connector part where the contacts of the pins move into electrical engagement with the contacts of the first connector part, thereby providing respective signal conduction paths through the connector.

The electrical contacts of the first connector part may be contact sockets. During mating the contact pins can engage in the contact sockets in the sealed chamber of the first connector part.

The first connector part may be a formed as a plug, and the second connector part may be formed as a receptacle adapted to receive the plug.

Viewed from a second aspect, the present invention provides an underwater connector comprising first and second connector parts capable of being mated underwater to form a plurality of water-tight electrical signal conduction paths through the connector from which the ambient water is excluded, and a conductor extending between the signal conduction paths, the conductor being earthed in use.

The conductor can suppress crosstalk between the signal conduction paths.

Preferably, the first connector part comprises the conductor. It is preferred that the first connector part comprises an environment of electrically non-conducting fluid (for example liquid or gel). The electrical signal conducting paths may be formed on mating by respective contacts of the first and second connector parts coming into engagement in the fluid environment.

The various preferred features of the first aspect of the invention are also applicable to the second aspect, either individually or in combination. Further, the above-described advantages of the first aspect of the invention are also provided by the second aspect of the invention.

The first connector part may be a connector part as discussed in this specification, in its broadest terms or including any of the optional or preferred features described.

The connector may be adapted to interface, in use, Ethernet communications across the signal conduction paths.

BRIEF DESCRIPTION OF THE DRAWINGS

Certain preferred embodiments of the present invention will now be described, by way of example only, with reference to the accompanying drawings, in which:

FIGS. 2A-2D show a series of axial side views of a cross-section of the connector part of the first embodiment of the present invention in progressive stages of mating with a complementary connector part to make a water-tight electrical connection therewith;

FIGS. 6A and 6B show views of the connector part according to the second embodiment in elevation, respectively, from an axially forward direction and from one side;

DETAILED DESCRIPTION

Figure 1B:
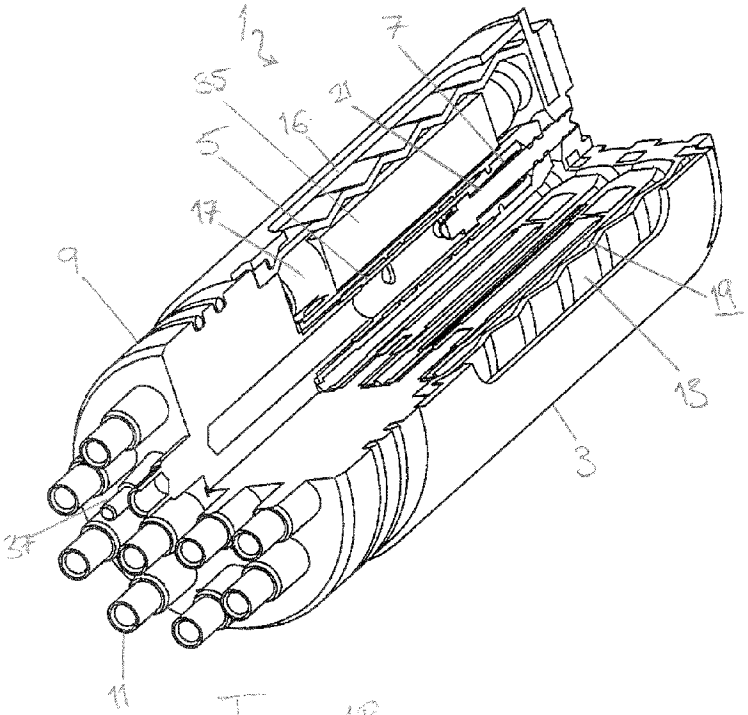
FIG. 1B shows an equivalent view from a position axially rearward of the connector part.
Figure 1A:
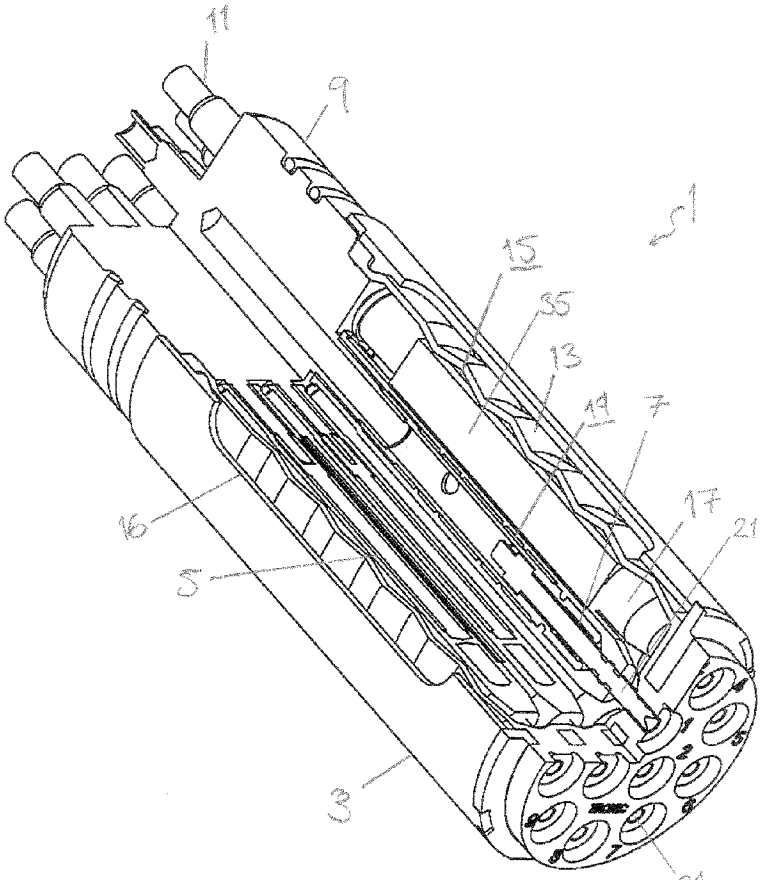
FIG. 1A shows a view of a partial cutaway of a connector part according to a first embodiment of the present invention from a position axially forward of the connector part.

Referring to FIGS. 1-4, a first embodiment of the invention provides a connector part 1, formed as a plug, arranged to mate with a complementary connector part 51, formed as a receptacle. The plug connector part 1 is provided at the end of a sealed oil-filled sub-sea tube (not shown) where it terminates an Ethernet cable and power cables provided inside the tube. The receptacle connector part 51 is provided at a bulkhead in a sub-sea control module (not shown) where it terminates an Ethernet cable and a power cable provided inside the sub-sea control module, which are connected to instrumentation therein. Ethernet communications signals and power to be provided from a remote location to the sub-sea control module are in this way sent to the sub-sea control module through the oil-filled tube. To interface the power and Ethernet communications with the sub-sea control module, the connector parts 1, 51 are wet-mated together while submerged, by, for example, a Remotely Operated Underwater Vehicle (ROV). In this way, the connector parts 1, 51 interface power and Ethernet communications provided from a remote location through the sub-sea tube to the sub-sea control module. The connector parts 1, 51 may, of course, alternatively be terminated in a number of different ways to interface Ethernet communications and also power sub-sea. For example, plug connector part 1 may alternatively be provided at a bulkhead in a sub-sea control module and the receptacle connector part 51 may be provided at the end of a sealed oil-filled sub-sea tube. Further still, the plug and connector part may be provided in or on any appropriate sub-sea equipment, interconnecting cabling, umbilical tubing, etc.

The axial directions referred to herein, by convention, point towards the mating direction of each connector part. Thus, the axially forward direction with respect to the plug connector part 1 is indicated by the arrow A in FIG. 2A. The axially forward direction with respect to the receptacle connector part 51 is indicated by the arrow B in FIG. 2A. Thus the axial directions of the plug 1 and receptacle 51 run parallel to each other, but face and oppose each other.

The receptacle connector part 51 is formed to have a cylindrical shroud (not shown) extending to surround twelve axially extending conductive elements foinied as contact pins 53, a bore of the cylindrical shroud thereby defining the receptacle for guiding and receiving the plug connector part 1 during mating. The contact pins 53 extend through and are supported by insert 55 formed of an insulating plastic material such as polyetheretherketone (PEEK) thermoplastic material, and each contact pin 53 has an axially extending electrically conductive core surrounded by an electrically insulating layer 57 which, for example, may also be formed of PEEK.

The conductive core of each of the contact pins 53 is exposed at an axially forward position of the contact pins 53 inside the receptacle to form a cylindrical electrical contact surface 59 flush with the PEEK insulation 57 located rearwardly thereof. In the de-mated state, the receptacle is free-flooded such that the connector pins are exposed to ambient conditions such as sea-water. The axially foremost point of each contact pin is provided as a protrusion 60 for positive engagement with a corresponding recess in the plug connector part 1 on mating and to exclude sea water therefrom. An opening (not shown) in the wall of the cylindrical shroud (not shown) allows water to be expelled from the receptacle as the plug is received therein on mating.

The conductive core of each of the contact pins 53 is also exposed at the axial rear of the insert 55 where the conductive cores are formed to provide solder cups 61 for termination of a respective conductor of a cable (e.g. Ethernet cable or power cable, not shown) inside the environmentally sealed enclosure of the sub-sea control module.

The twelve contact pins 53 are arranged to extend axially parallel, laterally spaced from one another, and in a cross-sectional arrangement distributed around two concentric circles. Three of the contact pins 53 are arranged at equal distances around an innermost circle, and the remaining nine contact pins 53 are arranged at equal distances around an outermost circle. Each one of eight of the contact pins 53 in the outer ring is electrically connected to one of the eight conductors of a twisted pair Cat 6 Ethernet cable (not shown). The Ethernet cable conductors are terminated at the relevant solder cups 61 at the rear of the receptacle connector part 51. The Ethernet cable extends inside the sub-sea control module and passes Ethernet signals transmitted to the eight contact pins 53 to the relevant instrumentation inside the sub-sea control module. The remaining four of the contact pins 53 are electrically connected to conductors of power cables (not shown) extending inside the sub-sea control module. The power cable conductors are terminated at their respective solder cups 61. The power cable passes power transmitted to the respective contact pins 53 to the relevant instrumentation inside the sub-sea control module.

The plug connector part 1 includes an outer shroud 3 (not shown in FIGS. 3 and 4) formed of a rigid plastic material surrounding twelve axially extending tubular conductive elements 5 formed as contact sockets. Each contact socket 5 has a contact surface 7 located axially rearwardly from the front of the shroud 3 inside the plug 1 and each contact socket 5 extends through and is supported by insert 9 formed of an insulating plastic material such as PEEK. Rearwardly of the insert 9, each contact socket 5 is formed to provide exposed solder cups 11 each for termination of a respective conductor of a cable (e.g. Ethernet cable or power cable, not shown) inside the environmentally sealed enclosure of the sub-sea oil-filled tube.

Figure 4B:
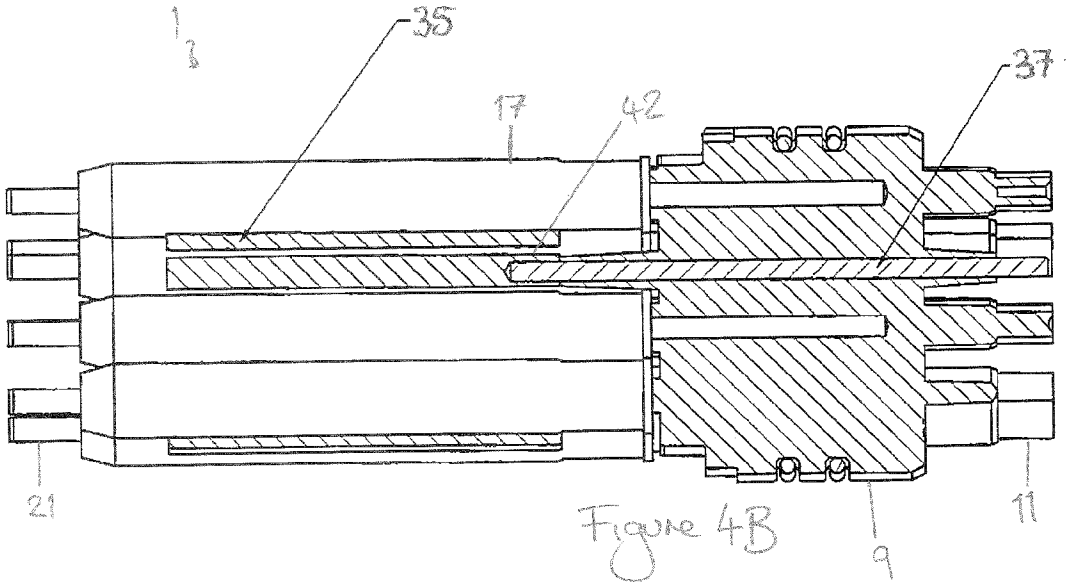
FIGS. 4A and 4B show views of the connector part according to the first embodiment in elevation, respectively, from an axially forward direction and from one side.
Figure 4A:
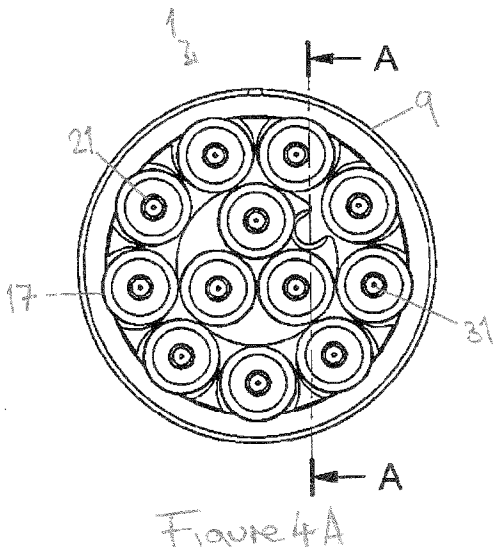

The contact sockets 5 are arranged to extend axially, laterally spaced from one another, and, as can be best seen in FIG. 4A, in a cross-sectional arrangement corresponding to the arrangement of contact pins 53 in the receptacle connector part 51. Each one of eight of the contact sockets 5 in the outer ring is electrically connected to one of the eight conductor cores of a twisted pair Cat 6 Ethernet cable (not shown) extending inside the oil-filled tube, which are terminated at the solder cups 11 at the rear of the plug connector part 1. Ethernet signals provided to the opposite end of the Ethernet cable at a remote location and passing along the Ethernet cable are interfaced by the relevant contact sockets 5 to the relevant contact pins 53 of the receptacle connector part 51 on mating of the connector parts. The remaining four of the contact sockets 5 are electrically connected to conductors of a power cable (not shown) extending inside the oil-filled tube, which are terminated at their respective solder cups 11. Electrical power provided to the opposite end of the power cable at a remote location and passing along the power cable is interfaced by the relevant contact sockets 5 to the relevant contact pins 53 of the receptacle connector part 51 on mating of the connector parts.

An outer bladder 13 (not shown in FIGS. 3 and 4) formed of a resilient, impermeable material, is sealed water-tight against the insert 9 and defines a chamber 15 in which all twelve of the contact sockets 5 extend. The outer surface of the outer bladder 13 is exposed to ambient conditions by a vent hole 16 in the shroud 3. Inside the chamber 15, each individual contact socket 5 is enclosed inside an axially extending individual bladder 17 formed of a resilient, impermeable material, which is sealed water-tight against an annular surface of the contact socket 5 at an axially rearward location on the contact socket 5, proximal to the insert 9. The individual bladders 17 form a plurality of sub-chambers 19, each containing a contact socket 5. The chamber 15 and each individual sub-chamber 19 are filled with an electrically insulating oil, and are sealed from each other such that they are not in fluid communication. This arrangement of bladders is such that pressure equalisation between the external environment and the chambers of the plug 1 is allowed by a change in volume of the chambers, thus reducing the tendency of sea-water to enter the chambers as the plug 1 is submerged to increasing depths and is wet-mated with the receptacle 51.

Figure 2A:
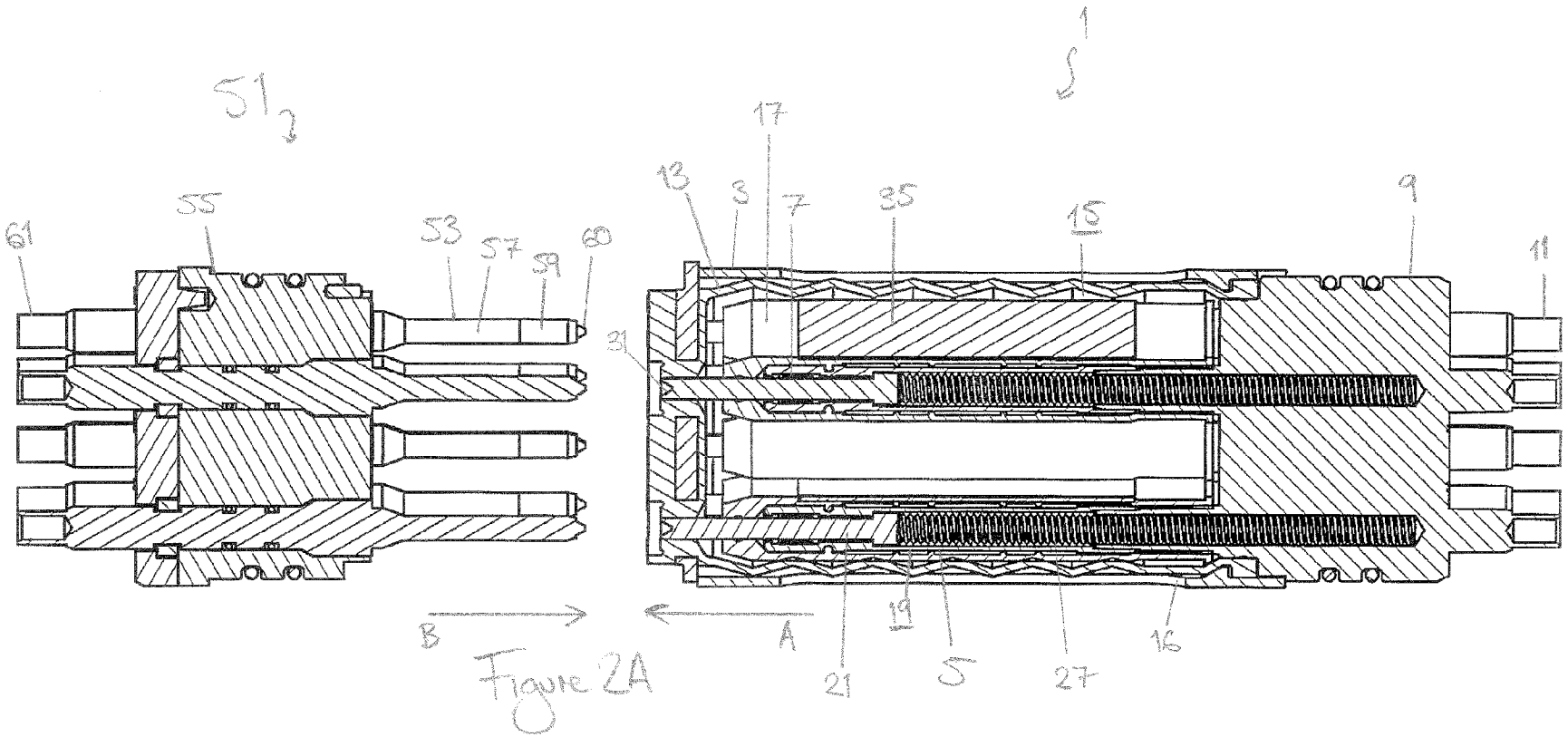
Figure 2C:
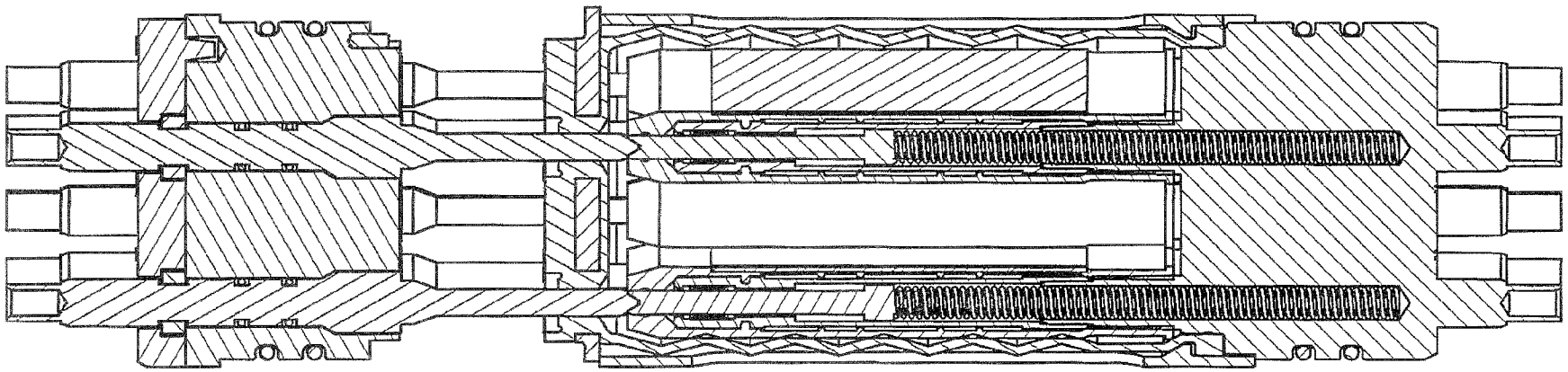
Figure 2D:
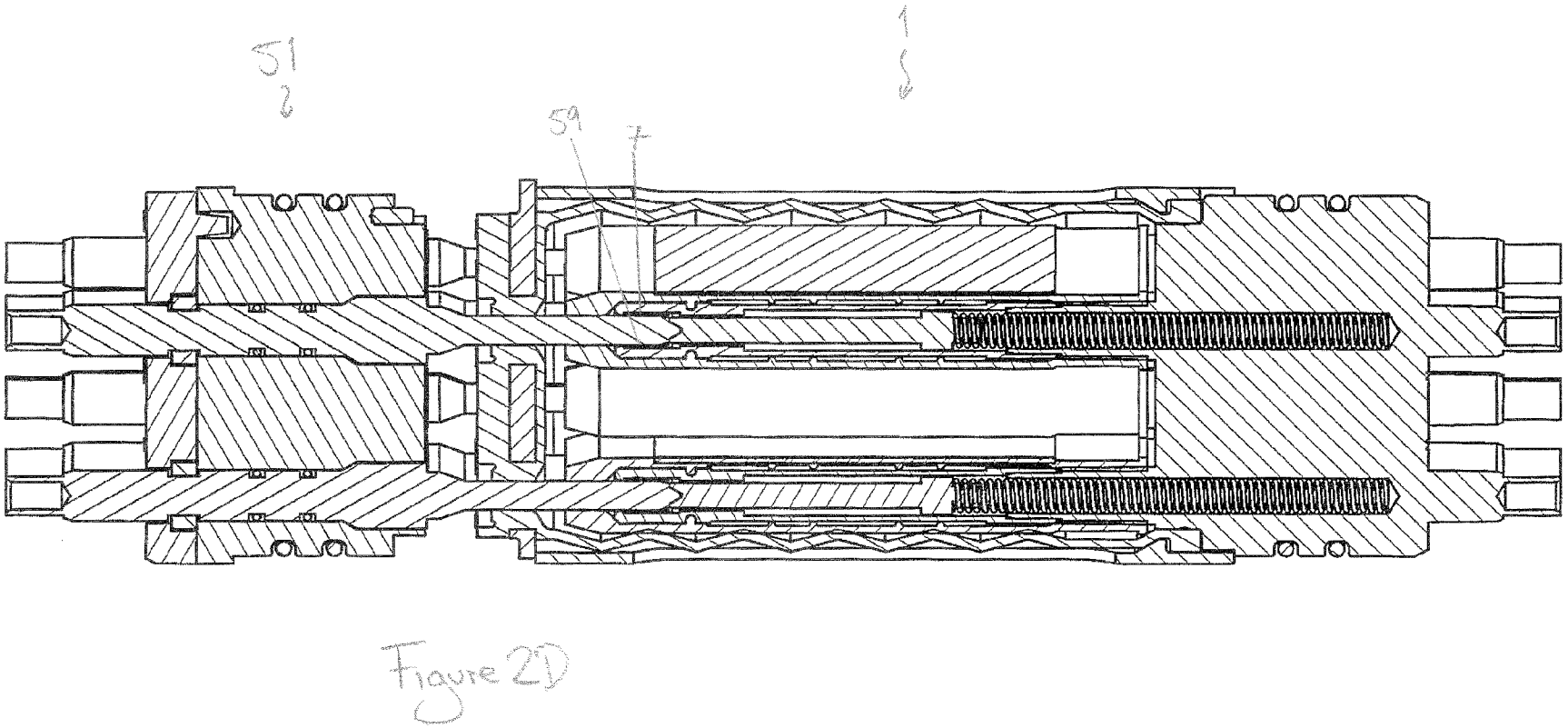

An axially extending shaft-like probe 21 extends inside each contact socket 5, and through openings in the respective individual bladder 17 and the outer bladder 13. A rib seal (not shown) is provided at the opening in each individual bladder 17 to seal each individual bladder 17 water-tight against the respective probe 21, and a rib seal (not shown) is similarly provided at each opening in the outer bladder 13 to seal the outer bladder 13 water-tight against each of the probes 21. Each probe 21 is resiliently biased to an axially forward position (as shown in FIG. 2A) by a helical coil spring 27 (not shown in FIG. 1) extending inside each contact socket 5 where each spring 27 engages the rear of the respective probe 21 at its foremost point and an axially forwardly facing face in the bore of the tubular the contact socket 5 at its rearmost point. Each probe 21 is moveable rearwardly against the biasing force of the respective spring 27 when the probe 21 is pressed backwards from the front of the plug 1. The axially foremost face of each probe 21 is provided with a recess 31 for positive engagement with the corresponding protrusion 60 in the respective contact pin 53 of the receptacle connector part 51 on mating, whereby sea water is almost completely expelled therefrom.

Figure 3B:
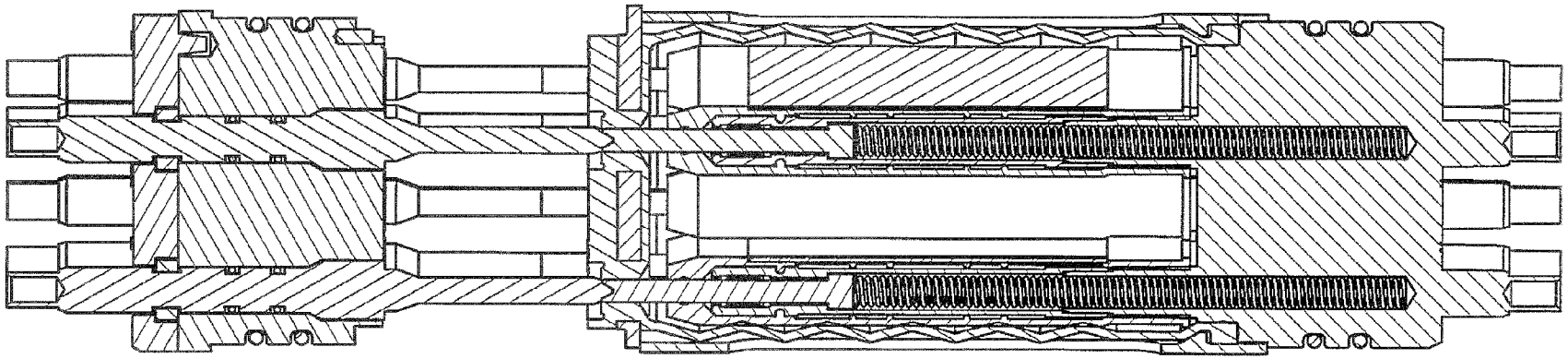
FIG. 3 shows a partially exploded view of a connector part according to a first embodiment of the present invention.
Figure 3:
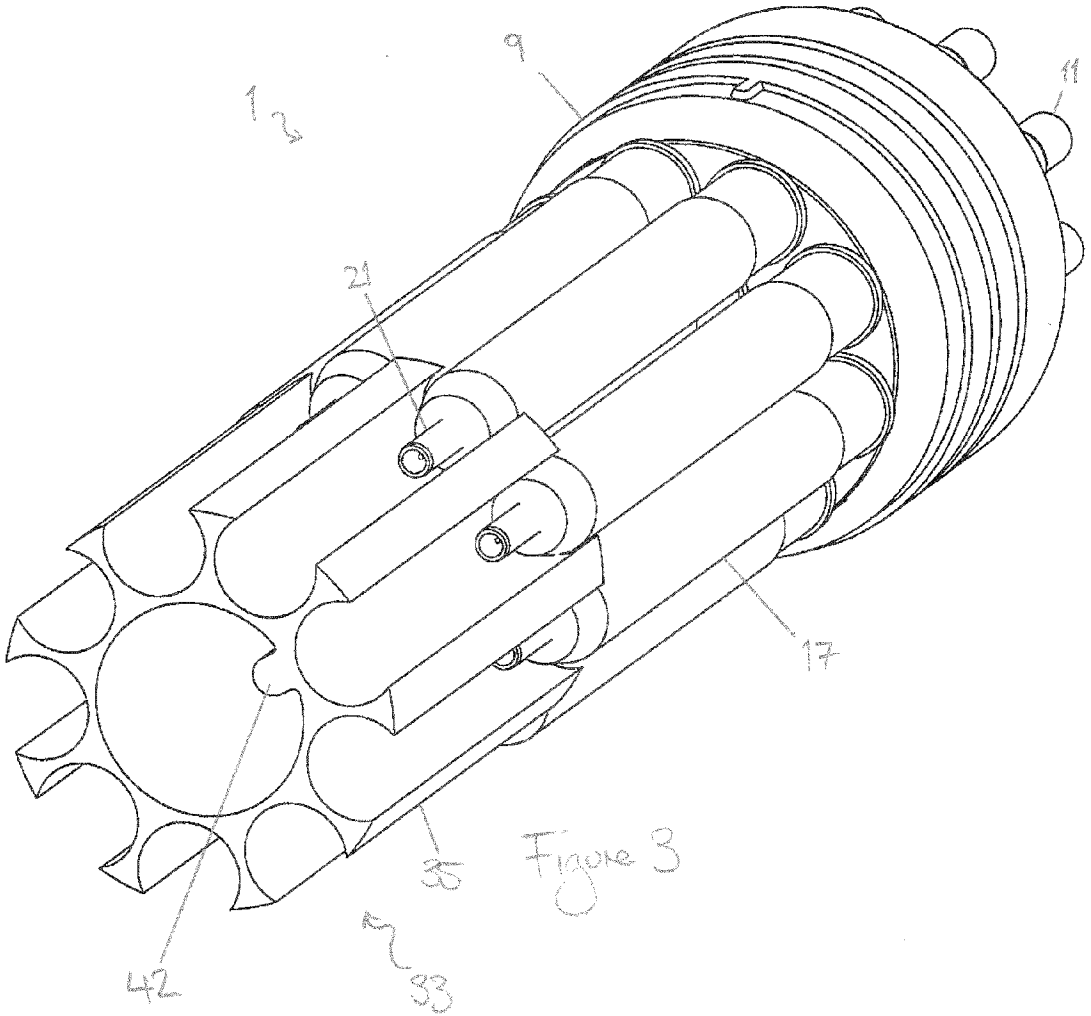

An electrically conductive crosstalk suppressing means 33, is provided including an insert 35 (shown in an exploded position in FIG. 3) provided inside the chamber 15. The insert 35 is formed to have, along its axial length, a uniform cross-sectional profile as shown in FIGS. 3 and 4A such that it can fit in the gaps between all nine of the individual bladders 17 surrounding the nine outer contact sockets 5, and around the three individual bladders 17 surrounding the central contact sockets 5. The insert 35 extends along a substantial portion of the axial length of the inside of the chamber 15. An earth pin 37 (not shown in FIG. 2) extends through and is supported by the insert 9 to electrically connect the crosstalk suppressing means 33 to a earthed drain wire (not shown) provided in the sub-sea oil-filled tube to electrically earth (which may be alternatively and equivalently referred to as ground, herein) the insert 35 at zero electrical potential across its surface. An inwardly protruding projection 42 is provided as part of the insert 35 to electrically contact the earth pin 37. The result of this arrangement is that any excess charge induced in the crosstalk suppressing means 33 by electrical fields generated proximal to the crosstalk suppressing means 33 are conducted to earth such that the crosstalk suppressing means 33 remains electrically neutral. As a result any electrical fields incident on the crosstalk suppressing means 33 are substantially not transmitted by the crosstalk suppressing means 33 and electrical field lines are instead terminated.

The process of mating of the plug connector part 1 and receptacle connector part 51 is shown in progression in FIGS. 2A-2D. By moving the plug 1 and receptacle 51 axially towards each other (see FIG. 2A), the plug 1 enters the bore inside the shroud of the receptacle 51 and the contact pins 53 of the receptacle 51 thereby become axially aligned with the fronts of the probes 21 of the plug 1 by the mating of a key and keyway (not shown) provided on the plug 1 and receptacle 51, respectively. After the protrusions 60 on the fronts of the contact pins 53 positively engage the recesses 31 in the fronts of the probes 21 (see FIG. 2B), the probes 21 begin move rearwardly against the bias of the springs 27. As the plug 1 further enters the receptacle, the receptacle is vented of sea water through hole 16 and each contact pin 53 passes through the outer bladder 13 and respective inner bladder 17 into the chamber 15 and respective sub-chamber 19 as it pushes its respective probe 21 rearwardly (see FIG. 2C). The O-ring seals provided in relation to the outer bladder 13 and inner bladders 17 engage the outer surface of the contact pins 53 and maintain the water-tight seal between the sub-chambers 19 and the chamber 15, and between the chamber 15 and the ambient sea-water. In the fully mated condition (see FIG. 2D) each contact pin 53 is located inside the respective sub-chamber 19 such that the electrical contact surface 59 of each contact pin 53 is seated inside the respective tubular contact socket 5 such that it electrically contacts with the electrical contact surface 7 respective tubular contact socket 5.

Thus in the fully mated condition, the connector parts 1, 51 provide twelve axially aligned electrical conductions paths, extending between the solder cups 11 at the rear ends of the contact sockets 5 to the solder cups 61 at the rear ends of the contact pins 53. Although the electrical connection is made by mating the connector parts 1, 51 underwater, the electrical conductions paths are sealed water-tight and surrounded only by electrically insulating oil in the sub-chambers 19 and the chamber 15, and under the electrically insulating PEEK layer 57 where the contact pins 53 protrude from the front of the plug 1 and extend to the insert 55 in the sea water-flooded receptacle.

The electrical connections can then become active. Eight of the electrical conduction paths around the outer ring then provide signal conduction paths for transmitting Ethernet signals between the eight twisted pair conductors of the Ethernet cable terminated at the rear of the plug 1 and the eight twisted pair conductors of the Ethernet cable terminated at the rear of the receptacle 51. The remaining four of the electrical conduction paths then provide power conduction paths for transmitting power from the conductors of the power cable terminated at the rear of the plug 1 to the conductors of the power cable terminated at the rear of the receptacle 51.

The electrically earthed crosstalk suppressing means 33 provides electrical shielding between each of the nine outer electrical conduction paths and between those and the three inner electrical conduction paths. The ability for Ethernet signals transmitted along any of the eight signal conduction paths to become coupled to each other becomes significantly reduced in the region of the crosstalk suppressing means 33, when compared to the coupling that would occur if the crosstalk suppressing means 33 were not provided. The arrangement of the connector of the invention including crosstalk suppressing means 33 is such that the level of crosstalk between the eight signal conduction paths across the interfacing provided by the connector parts 1, 51 is sufficiently low that the requirements of the relevant TIA/EIA and/or ISO/IEC Ethernet standards are met. Thus, the plug connector part 1 of the invention can be used in conjunction with the receptacle connector part 51 to interface Ethernet communications sub-sea in a water-tight, wet mateable connection. The resulting Ethernet communications are compliant with the relevant standards, with low crosstalk, and thus any potential problems and hazards such as data corruption, or incorrect addressing of well instrumentation instructions that can result from crosstalk, are avoided. As a result, a high density data throughput can be reliably provided by deploying Ethernet sub-sea. Any suitable Ethernet protocol can be interfaced using the connector parts 1, 51, and, depending on the hardware and cabling used, 10BASE-T and 100BASE-TX can be supported to provide sub-sea data transfer rates of 10 Mbit/s and 100 Mbit/s. The arrangement could also be used to interface higher data rate Ethernet protocols such as 1000BASE-T providing 1000 Mbit/s.

Figure 5:
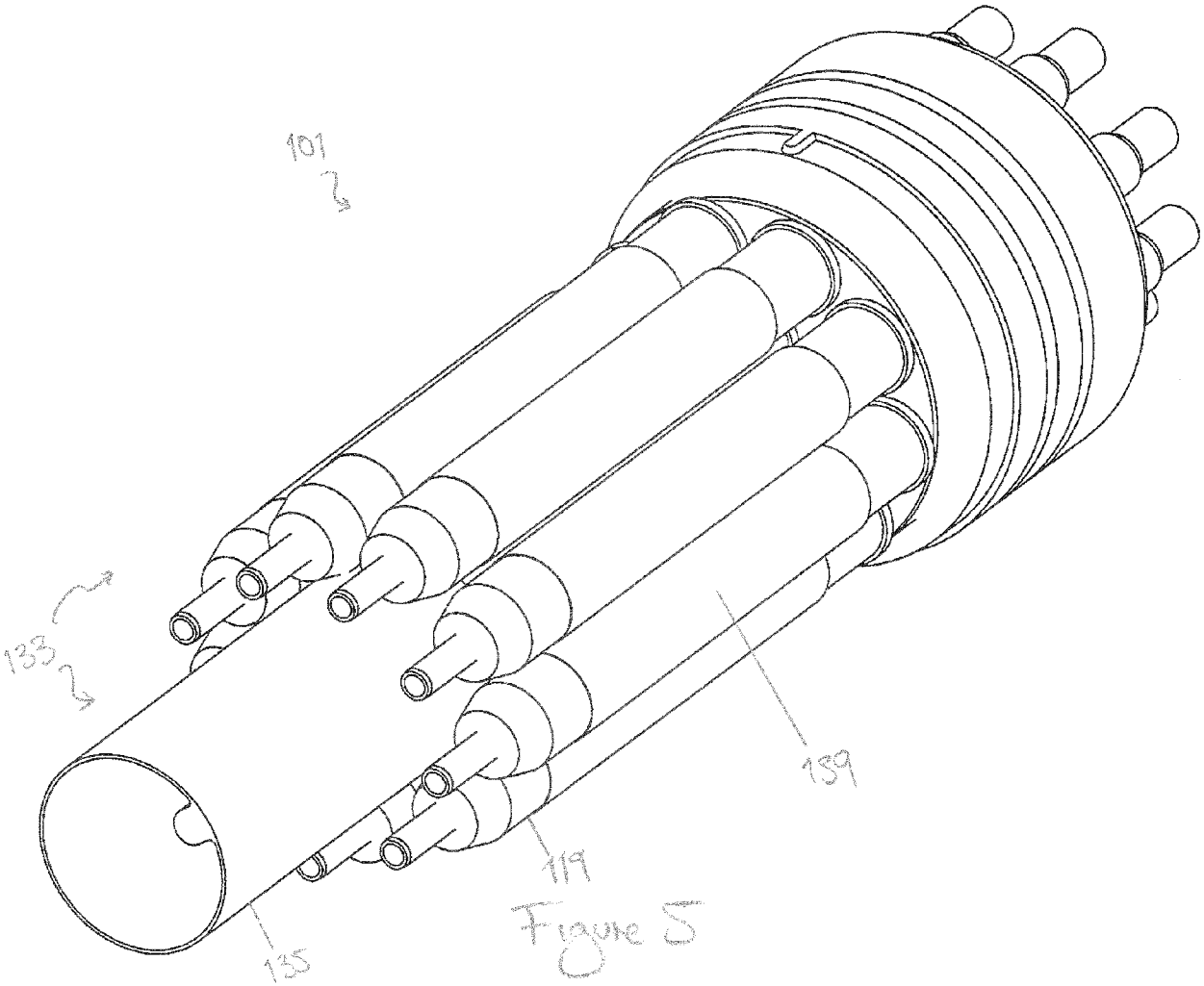
FIG. 5 shows a partially exploded view of a connector part according to a second embodiment of the present invention.
Figure 8B:
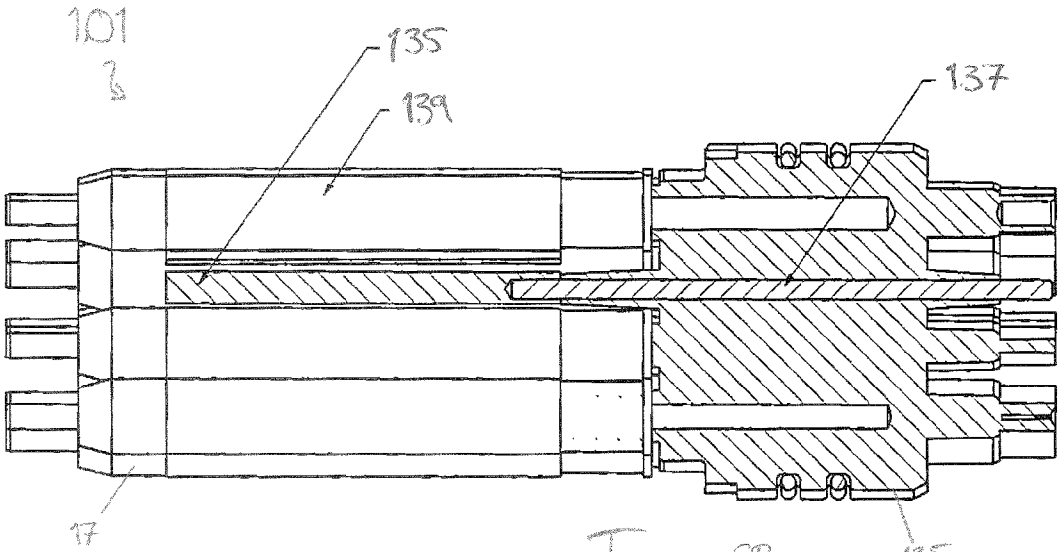
FIGS. 8A and 8B show views of the connector part according to the second embodiment in elevation, respectively, from an axially forward direction and from one side.
Figure 8A:
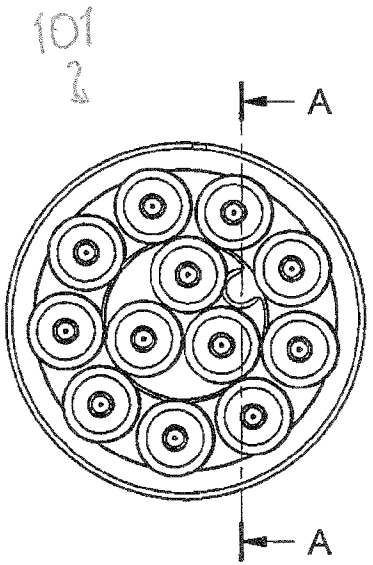

FIGS. 5 and 6 disclose a second embodiment of the plug connector part 101 of the present invention. All features of the plug 101 of this embodiment, other than the crosstalk suppressing means 133, correspond to the features of the plug 1 of the first embodiment, and so a discussion of these features will not be repeated here. However, a difference relative to the first embodiment is that the insert 135 of the crosstalk suppressing means 133 is formed to have a substantially circular cross section such that they surround only the individual bladders 17 of the three central contact sockets 5 and do not extend in the gaps between the individual bladders 17 of the nine outer contact sockets 5. Instead, each of the individual bladders 17 of the nine outer contact sockets 5 is surrounded by an axially extending metal layer 139, provided as metal foil wrapped around the bladder surface. The metal layers 139 are electrically connected to the earth pin 137 through the insert 135, with which the metal layers 139 are in surface contact. The metal layers 139 thus electrically shield from each other the nine electrical conduction paths arranged on the outer ring, and, in use, suppress crosstalk between the eight signal conduction paths carrying Ethernet signals.

Figure 7:
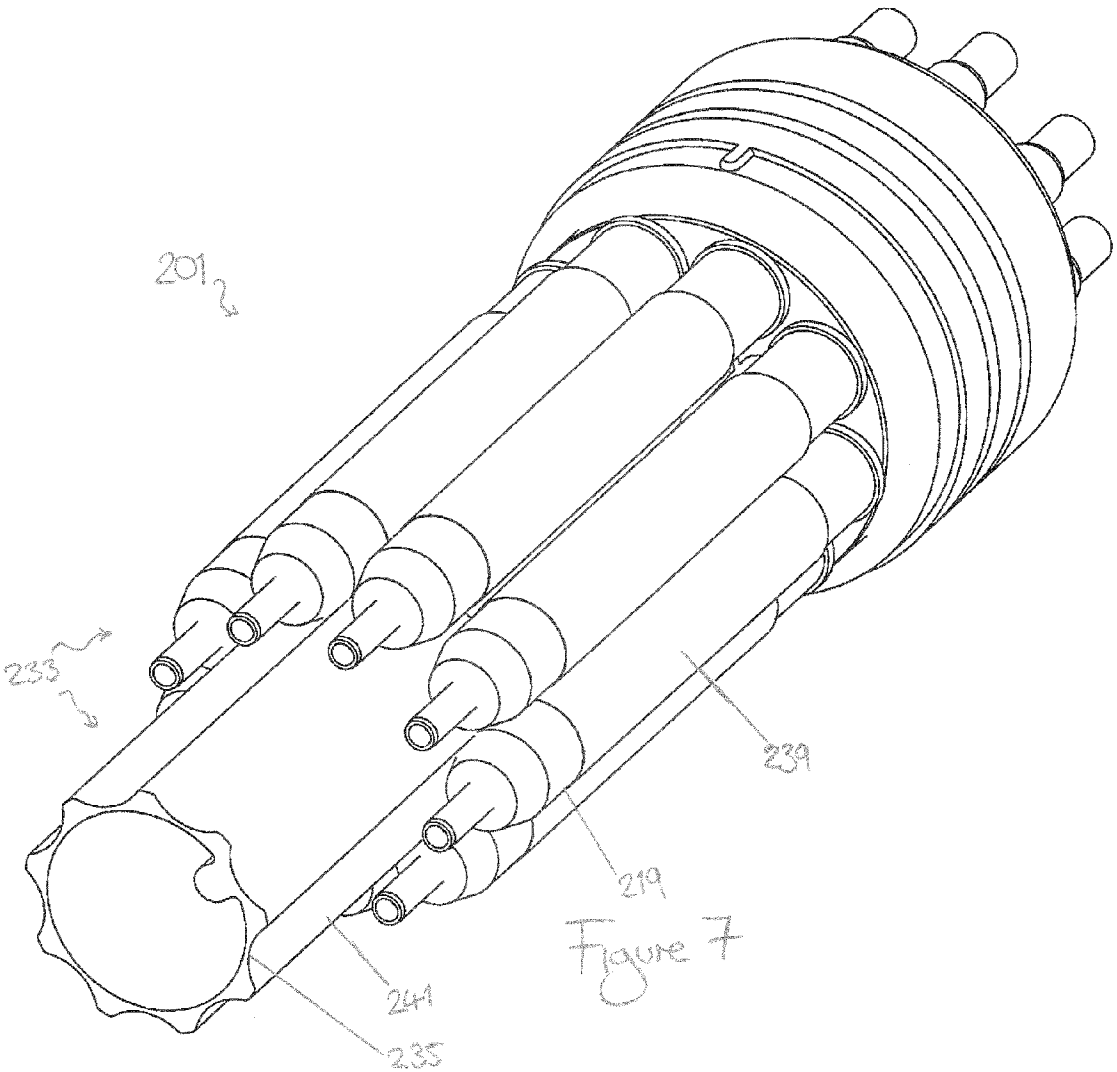
FIG. 7 shows a partially exploded view of a connector part according to a third embodiment of the present invention.
Figure 8B:
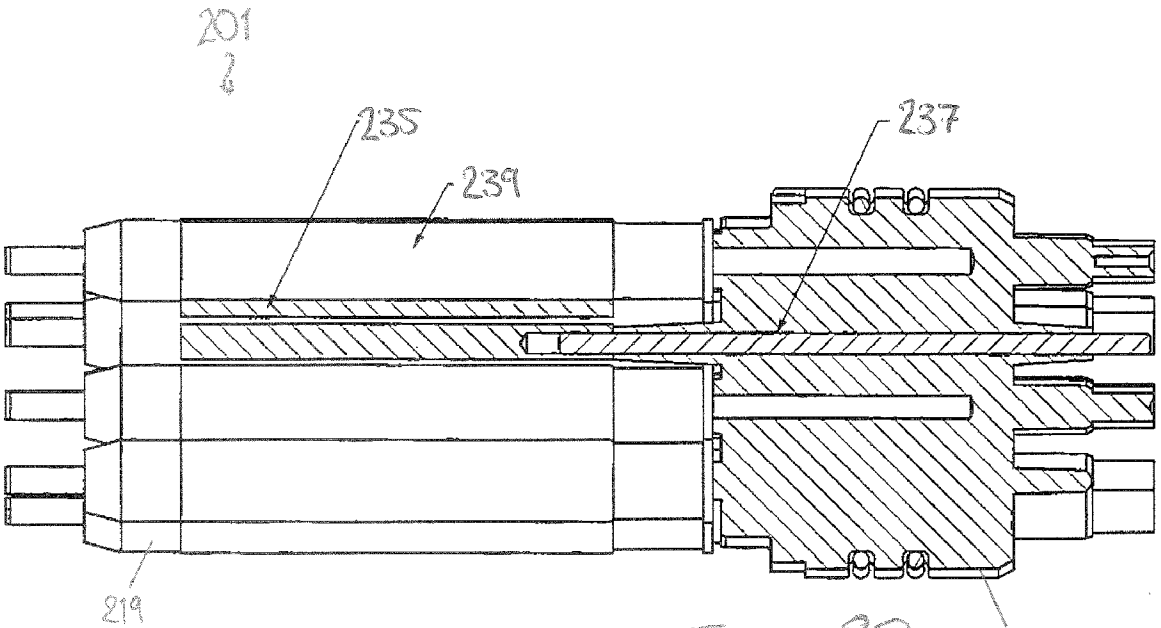
Figure 8A:
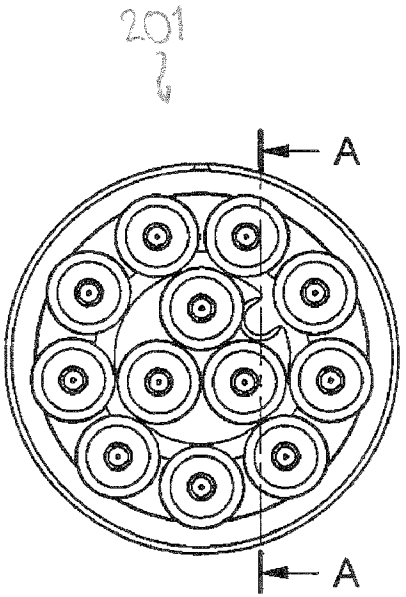

FIGS. 7 and 8 disclose a third embodiment of the plug connector part 201 of the present invention very similar to the second embodiment, with the addition of axial protrusions 241 along the length of the insert 235 of the crosstalk suppressing means 233 which are arranged to extend a small distance into the gaps between the in individual bladders 219 surrounding the nine outer contact sockets 205. These axial protrusions 241 provide an insert 235 having an outer surface that closely contacts the metal foil 239 surrounding the individual bladders 219 surrounding the nine outer contact sockets 205, thereby ensuring a sound electrical connection therebetween, and earthing thereof.

Figure 9:
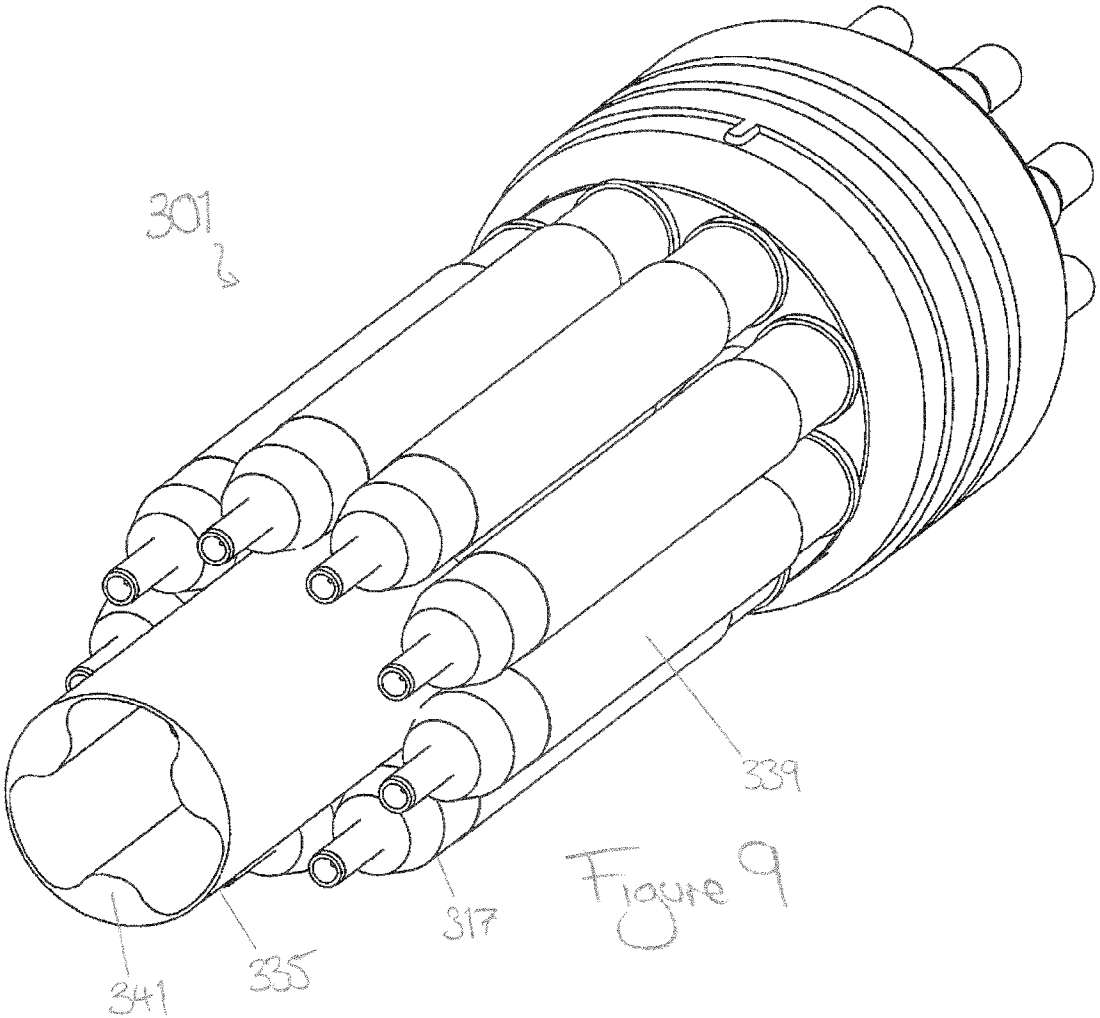
FIG. 9 shows a partially exploded view of a connector part according to a fourth embodiment of the present invention.
Figure 10B:
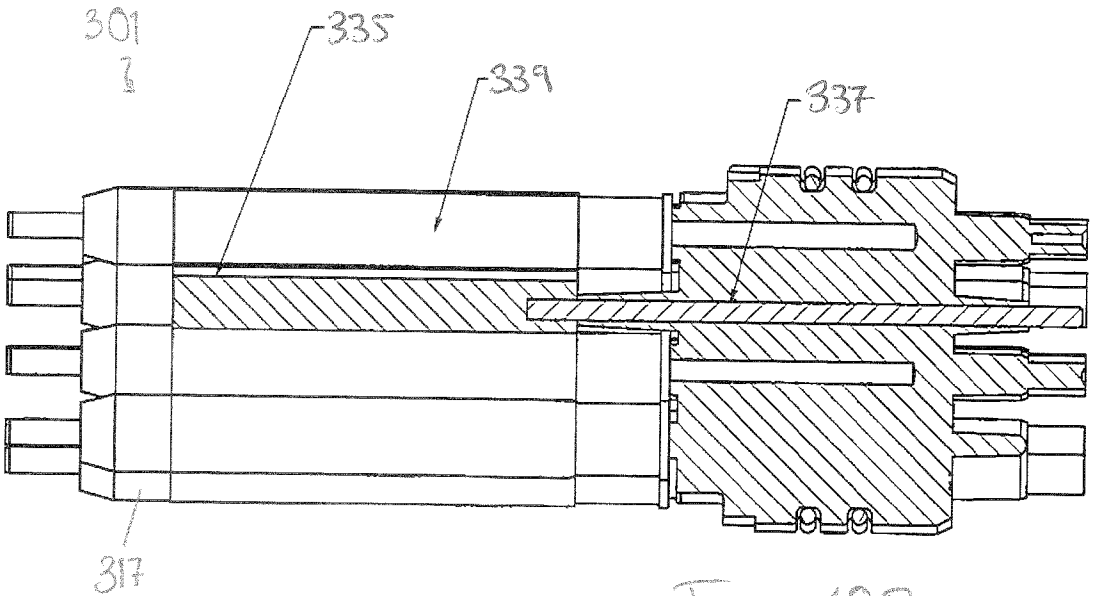
FIGS. 10A and 10B show views of the connector part according to the second embodiment in elevation, respectively, from an axially forward direction and from one side.
Figure 10A:
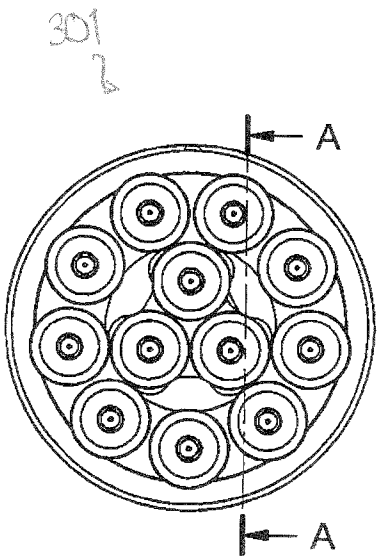

FIGS. 9 and 10 disclose a fourth embodiment of the plug connector part 301 of the present invention very similar to the second and third embodiments, with the addition of axial protrusions 341 along the length of the insert 335 arranged to extend inwardly a small way into the gaps between the individual bladders 317 of the three inner contact sockets 305.

In all embodiments of the present invention, the crosstalk suppressing means is arranged such that the signal conduction paths are electrically shielded from each other in use to the extent required to achieve the desired level of crosstalk suppression, or to meet the relevant Ethernet standards.

Use of the present invention is not restricted to interfacing with sub-sea equipment for oil and gas development, but can also find utility in interfacing with systems in other sub-sea or harsh environment applications, such as off-shore wind turbines, wave or tidal power systems, remotely operated underwater vehicles (ROVs), and systems used in monitoring of marine biology or oceanography.

Instead of twelve electrical conduction paths through the connector, a different number of electrically conductive pins and sockets may be provided. Preferably, at least eight pins and sockets are provided to provide terminations and separate signal conducting paths for the eight conductors of a twisted pair Ethernet cable. However, in some standard Ethernet protocols, only four conductors of a twisted pair Ethernet cable are used, and so the connector present invention could include only four pins and sockets.

The Ethernet cable terminated at the connector parts may be Cat 5, Cat 5e, Cat 6 or Cat 7 twisted pair cabling. However, any other suitable multi-core cabling in which (shielded) Ethernet signals are transmitted can be terminated by the connector parts. As mentioned above, the connector parts can be used to interface Ethernet communications according to any standard.

In the first embodiment, to provide additional crosstalk suppression, metal foil may be wrapped around the outside of the insert 35, and the nine individual bladders 17.

The invention claimed is:

1. An underwater connector comprising first and second connector parts capable of being mated underwater, wherein the first connector part comprises first and second axially extending, electrically conductive signal-carrying elements, the first connector part being configured such that, on mating with the second connector part in normal use, the signal-carrying elements electrically contact with respective signal-carrying elements of the second connector part to form a plurality of electrical signal conduction paths through the connector from which the ambient water is excluded, the signal conduction paths between the connector parts being sealed watertight so that they are not exposed to ambient water, wherein a conductor extends between the signal conduction paths, the conductor being arranged to be earthed in use and arranged to, in use, electrically shield the signal conduction paths from each other to suppress signal crosstalk therebetween, and wherein the first connector part comprises a sealed chamber filled with electrically non-conducting fluid, the signal-carrying elements of the first connector part being arranged so that on mating of the first and second connector parts the signal-carrying elements of the first connector part electrically contact with the respective signal-carrying elements of the second connector part in said sealed chamber, and the conductor for suppressing signal crosstalk extending in the sealed chamber.

2. A connector as claimed in claim 1, wherein the first connector part comprises individual chambers in said sealed chamber and filled with electrically non-conducting fluid, the signal-carrying elements of the first connector extending in said individual chambers, and the conductor for suppressing signal crosstalk extending in said sealed chamber and between the individual chambers.

3. A connector as claimed in claim 1, wherein the conductor for suppressing signal crosstalk extends at least partly circumferentially round each of the signal-carrying elements of the first connector part.

4. A connector as claimed in claim 3, wherein the conductor for suppressing signal crosstalk comprises a conductive insert member.

5. A connector as claimed in claim 1, further comprising an earth connector extending to the back of the first connector part arranged, in use, to electrically connect the conductor for suppressing signal crosstalk to earth.

6. A connector as claimed in claim 5, wherein the signal-carrying elements of the first connector part extend in and project forwardly from a supporting member, and wherein the earth connector extends axially through the supporting member.

7. A connector as claimed in claim 1, wherein the signal-carrying elements of the first connector part terminate conductors of twisted pair Ethernet cabling.

8. A connector as claimed in claim 1, wherein the first connector part comprises four signal-carrying elements each electrically connected to a different one of four conductors of a twisted pair Ethernet cable, the conductor for suppressing signal crosstalk being arranged to suppress crosstalk between the four respective signal conduction paths.

9. A connector as claimed in claim 1, wherein the first connector part comprises eight signal-carrying elements each electrically connected to a different one of eight conductors of a twisted pair Ethernet cable, the conductor for suppressing signal crosstalk being arranged to suppress crosstalk between the eight respective signal conduction paths.

10. A connector as claimed in claim 1, wherein the first connector part comprises four power-carrying elements.

11. A connector as claimed in claim 1, wherein the signal-carrying elements of the first connector part comprise electrical contacts for making respective electrical connections with respective contacts of the signal-carrying elements of the second connector part, the signal-carrying elements of the second connector part being formed as axially extending electrical contact pins; and wherein the connector is configured such that, on mating the first and second connector parts in normal use, the contact pins of the second connector part enter the sealed chamber of the first connector part where the contacts of the pins move into electrical engagement with the contacts of the first connector part, thereby providing said respective signal conduction paths through the connector.

12. An underwater connector comprising first and second connector parts capable of being mated underwater, wherein the first connector part comprises first and second axially extending, electrically conductive signal-carrying elements, the first connector part being configured such that, on mating with the second connector part in normal use, the signal-carrying elements electrically contact with respective signal-carrying elements of the second connector part to form a plurality of electrical signal conduction paths through the connector from which the ambient water is excluded, the signal conduction paths between the connector parts being sealed watertight so that they are not exposed to ambient water, wherein a conductor extends between the signal conduction paths, the conductor being arranged to be earthed in use and arranged to, in use, electrically shield the signal conduction paths from each other to suppress signal crosstalk therebetween, and wherein the first connector part comprises individual chambers filled with electrically non-conducting fluid, the signal-carrying elements of the first connector part extending in said individual chambers and being arranged so that on mating of the first and second connector parts the signal-carrying elements of the first connector part electrically contact with the respective signal-carrying elements of the second connector part in said individual chambers, and the conductor for suppressing signal crosstalk extending between the individual chambers.

13. A connector as claimed in claim 12, wherein the conductor for suppressing signal crosstalk extends at least partly circumferentially round each of the signal-carrying elements of the first connector part.

14. A connector as claimed in claim 13, wherein the conductor for suppressing signal crosstalk comprises a conductive insert member.

15. A connector as claimed in claim 12, wherein the conductor is immersed in an electrically non-conducting fluid.

16. An underwater connector comprising first and second connector parts capable of being mated underwater, wherein the first connector part comprises first and second axially extending, electrically conductive signal-carrying elements, the first connector part being configured such that, on mating with the second connector part in normal use, the signal-carrying elements electrically contact with respective signal-carrying elements of the second connector part to form a plurality of electrical signal conduction paths through the connector from which the ambient water is excluded, the signal conduction paths between the connector parts being sealed watertight so that they are not exposed to ambient water, wherein a conductor extends between the signal conduction paths, the conductor being arranged to be earthed in use and arranged to, in use, electrically shield the signal conduction paths from each other to suppress signal crosstalk therebetween, and wherein the first connector part comprises individual chambers filled with electrically non-conducting fluid, the signal-carrying elements of the first connector part extending in said individual chambers and being arranged so that on mating of the first and second connector parts the signal-carrying elements of the first connector part electrically contact with the respective signal-carrying elements of the second connector part in said individual chambers, and the conductor for suppressing signal crosstalk being located inside one of the individual chambers.

17. A connector as claimed in claim 16, comprising a plurality of conductors for electrically shielding the signal conduction paths from each other to suppress signal crosstalk therebetween, each conductor being located in a respective individual chamber.

18. An underwater connector comprising first and second connector parts capable of being mated underwater, wherein the first connector part comprises an axially extending, electrically conductive power-carrying element, and wherein the second connector part comprises an axially extending, electrically conductive power-carrying element, the connector being configured such that, on mating of the first and second connector parts in normal use, the power-carrying element of the first connector part electrically contacts with the power-carrying element of the second connector part to form a power conduction path between the connector parts, the power conduction path being sealed watertight, wherein the first connector part comprises first and second axially extending, electrically conductive signal-carrying elements, the first connector part being configured such that, on mating with the second connector part in normal use, the signal-carrying elements electrically contact with respective signal-carrying elements of the second connector part to form a plurality of electrical signal conduction paths through the connector from which the ambient water is excluded, the signal conduction paths between the connector parts being sealed watertight so that they are not exposed to ambient water, and wherein a conductor extends between the signal conduction paths, the conductor being arranged to be earthed in use and arranged to, in use, electrically shield the signal conduction paths from each other to suppress signal crosstalk therebetween.

19. A connector as claimed in claim 18, wherein the first connector part comprises an environment of electrically non-conducting fluid, arranged so that on mating the signal-carrying elements of the first connector part electrically contact with the respective signal-carrying elements of the second connector part in said environment.

20. An underwater connector comprising first and second connector parts capable of being mated underwater, wherein the first connector part comprises first and second axially extending, electrically conductive signal-carrying elements, the first connector part being configured such that, on mating with the second connector part in normal use, the signal-carrying elements electrically contact with respective signal-carrying elements of the second connector part to form a plurality of electrical signal conduction paths through the connector from which the ambient water is excluded, the signal conduction paths between the connector parts being sealed watertight so that they are not exposed to ambient water, wherein a conductor extends between the signal conduction paths, the conductor being arranged to be earthed in use and arranged to, in use, electrically shield the signal conduction paths from each other to suppress signal crosstalk therebetween, and wherein the first connector part comprises eight signal-carrying elements each electrically connected to a different one of eight conductors of a twisted pair Ethernet cable, the conductor for suppressing signal crosstalk being arranged to suppress crosstalk between the eight respective signal conduction paths.

* * * * *